US007084396B2

(12) United States Patent
Schneider

(10) Patent No.: US 7,084,396 B2
(45) Date of Patent: Aug. 1, 2006

(54) METHOD FOR INCREASING IONIZATION EFFICIENCY IN MASS SPECTROSCOPY

(75) Inventor: Luke V. Schneider, Half Moon Bay, CA (US)

(73) Assignee: Target Discovery, Inc., Palo Alto, CA (US)

( * ) Notice: Subject to any disclaimer, the term of this patent is extended or adjusted under 35 U.S.C. 154(b) by 0 days.

(21) Appl. No.: 10/696,549

(22) Filed: Oct. 28, 2003

(65) Prior Publication Data

US 2005/0001162 A1 Jan. 6, 2005

Related U.S. Application Data

(60) Provisional application No. 60/422,393, filed on Oct. 29, 2002.

(51) Int. Cl.
*H01J 49/26* (2006.01)

(52) U.S. Cl. ..... 250/288

(58) Field of Classification Search ..... 250/288, 250/424, 281, 282, 423 R, 423 P
See application file for complete search history.

(56) References Cited

U.S. PATENT DOCUMENTS

| | | | | |
|---|---|---|---|---|
| 5,101,105 | A | 3/1992 | Fenselau et al. | |
| 6,218,672 | B1 | 4/2001 | Alig | |
| 6,541,767 | B1 * | 4/2003 | Kato | 250/288 |
| 6,660,999 | B1 * | 12/2003 | Bemish | 250/282 |
| 6,812,459 | B1 * | 11/2004 | Fischer et al. | 250/288 |

* cited by examiner

*Primary Examiner*—Kiet T. Nguyen
(74) *Attorney, Agent, or Firm*—Townsend and Townsend and Crew LLP

(57) ABSTRACT

A mass spectrometry ionization method in which electrospray droplets or solid sample matrices are exposed to an ion beam thereby increasing the unbalanced charge of the analyte is provided. In another embodiment, a mass spectrometry ionization method in which ionization of the sample is achieved by directing an ion beam at a liquid or solid sample matrix containing analyte thereby ionizing and adding unbalanced charge to the analyte is provided.

5 Claims, 3 Drawing Sheets

METHOD FOR INCREASING IONIZATION EFFICIENCY IN MASS SPECTROSCOPY

CROSS-REFERENCES TO RELATED APPLICATIONS

This application claims the benefit of U.S. Provisional Patent Application No. 60/422,393, filed Oct. 29, 2002, the content of which is incorporated herein by reference.

STATEMENT AS TO RIGHTS TO INVENTIONS MADE UNDER FEDERALLY SPONSORED RESEARCH OR DEVELOPMENT

NOT APPLICABLE

Reference to a "Sequence Listing," a Table, or a Computer Program Listing Appendix Submitted on a Compact Disk

NOT APPLICABLE

BACKGROUND OF THE INVENTION

Discrimination and rapid identification of fleetingly small traces (down to single molecules) of chemicals from within fluctuating chemical backgrounds are the pervasive goals of analytical chemistry. A wide range of military, public, and private applications demand continued improvement in chemical detection methods: contraband (drugs and explosives) detection in the mail, in airports, at border crossings, in the schools and the workplace; forensics; chemical and biological defense (explosives, chemical and biological weapons); human and veterinary diagnostics; adsorption, deposition, metabolism, excretion, and toxicology studies conducted on human and veterinary therapeutics, agricultural chemicals, and in industrial biology; environmental fate; and bioinformatics and high throughput screening Aerosolized chemical toxins, either from industrial or military release, pose a clear threat to military forces in many theaters of operation. Explosives (mines) and munitions detection is a critical military mission for chemical detectors. Military threats also include overt and covert use of conventional or new chemical warfare (CW) agents. Potential nonmilitary threats include: industrial pollution (e.g., in the Eastern Block and many developing nations) and collateral or intentional damage of industrial sites (e.g., the oil well fires set during Operation Desert Storm).

Current chemical detection systems depend upon the accumulation of a sufficient mass of agent in order to achieve detection above background, which limits their intrinsic sensitivity. Spectroscopic detection methods are often used to distinguish a known chemical species from fluctuating natural chemical backgrounds. Chemical specific probes, such as antibodies or molecularly imprinted adsorbents, have proved difficult to develop for small molecule organic compounds, leaving direct detection methods (e.g., surface acoustic wave devices, mass spectrometers, and optical systems) the only currently-viable methods to detect most chemical agents. This mass sensitivity issue also makes these detection systems difficult to miniaturize since sufficient mass can be difficult to accumulate in a small space, which means point sensors for chemical detection require conspicuous and expensive collection preconcentration systems.

Other major chemical detection applications for mass spectrometers include contraband and explosives detection; food, beverage, and cosmetic product quality control; food safety and quality assurance; and ventilation control (offices and airplanes). The Congressional Budget Office (CBO) estimated in 1997 that US governments at all levels spend $1 B/y on the care and training of sniffer dogs for the detection of contraband, explosives, or rescue operations in the public arena. (Congression Budget Office estimate reported in US News & World Report (November, 1997)). Prior to 2001 the FAA failed to adopt mass spectrometer based detection strategies at US airports because of their demonstrated lack of sensitivity (generally in the 1–100 fmole range for explosives).

One of the USPS' highest priority interests is in the detection of fraudulent or prohibited mailings. Ted Kazinski (the "Unibomber") has once again highlighted the need for a broad, but sensitive screen, without intrusion. Mercury has been found in a parcel on-board an airplane. The catastrophic poisoning potential of such a material, following a leak during flight, could be devastating. In addition, biologic agents could also be addressed, which is a heightened issue with the recent outbreak of hoof-and-mouth disease in Europe. Among the materials with which the Postal Service concerns itself are marijuana, methamphetamine, cocaine and heroin.

Two key issues with which the USPS must concern itself, when reviewing and planning for systems integration of sensors and user-interfaces, include: false alarm rate (must be kept as low as possible) and impact on mail sorting and transporting throughput. MS detection systems would uniquely meet these requirements if it were not for their poor overall detection efficiency. The problem with MS-based sensors is the current need for comparatively large concentrations of the contraband to obtain detection. Because the contraband is inside a package, often with intent to conceal from sniffer dogs, detectable concentrations are typically below current MS detection levels.

Mass spectroscopy currently enjoys a premier position in forensics because it is one of the few analytical technologies that can unambiguously identify chemical analytes. A critical issue in forensics, however, is the limited amount of sample available for testing. Higher sensitivity MS technology may significantly improve forensic science and result in higher conviction rates. Forensic applications are also not just limited to law enforcement agencies, but are also of keen interest in the intelligence community for treaty compliance and rogue state monitoring for weapons of mass destruction, parents and management searching rooms, offices, factories, and schools for illicit drugs.

Industrial environmental monitoring is another major application area for mass spectrometers both from environmental protection and industrial hygiene perspectives. Emerging applications include food and beverage safety and quality control as well as odor control in buildings and commercial airlines.

Another application requiring higher sensitivity MS technology is in the collection of biological information (e.g., genomics, proteomics, and metabolomics). Mass spectrometry plays a critical and increasing role in the collection of biological information. The next generation of high throughput and low cost gene sequencing—necessary for the cost effective identification of single nucleotide polymorphisms (SNPs), widespread genotyping for genetic diseases, disease predilection screening, as well as therapeutic tolerance and outcome prediction—is built on MS technology. (Butler, J. M., J. Li, J. A. Monforte, and C. H. Becker, "DNA typing by mass spectrometry with polymorphic DNA repeat markers"; U.S. Pat. No. 6,090,558, (Jul. 18, 2000); Schmidt, G., A. H. Thompson, R. A. W. Johnstone, "Compounds for mass spectrometry comprising nucleic acid bases and aryl ether mass markers"; Eur. Patent 1042345A1 (Oct. 11, 2000); Schmidt, G., A. H. Thompson, R. A. W. Johnstone, "Mass label linked hybridisation probes," Eur. Patent 979305A1

(Feb. 16, 2000); Koster, H., "DNA sequencing by mass spectrometry," U.S. Pat. No. 6,194,144 (Feb. 27, 2001)). All protein identification and sequencing is now almost exclusively conducted by MS. Peptide fingerprinting and de novo peptide sequencing by tandem MS are almost universally practiced nonproprietary methods. (Shevchenko, A., et al., "Linking genome and proteome by mass spectrometry: Large-scale identification of yeast proteins from two dimensional gels," *Proc. Natl. Acad. Sci.* (*USA*), 93:14440–14445 (1996); Yates, J. R., S. Speicher, P. R. Griffin, and T. Hunkapiller, "Peptide mass maps: a highly informative approach to protein identification," *Anal. Biochem.,* 214: 397–408 (1993)). Even the classic Edman digestion approach has been adapted to the MS (Aebersold, R. et al., *Protein Sci.,* 1:494–503 (1992)) because of the lower sample requirements and increased speed the MS offers. Inverted mass ladder sequencing, an ultra-fast de novo protein sequencing method, (Schneider, L. V. et al., "Methods for determining protein and peptide terminal sequences" Provisional Patent Nos. 60/242398 and 60/242165 (2000)) also uses an ESI-TOF MS. Stable isotope ratio MS is being used for generating metabolic data (metabolomics). (Schneider, L. V. et al., "Metomics," U.S. patent application Ser. No. 09/553424 (2000)). The recent invention of mass spectrometer-based differential display techniques, such as isotope coded affinity tags (ICAT™) (Aebersold, R. H., et al., WO 00/11208 (Mar. 2, 2000)) and isotope differentiated binding energy shift tags (IDBEST™) (Schneider, L. V. et al., WO 01/49951 (Aug. 29, 2002); Hall, M. P. et al., poster presented at the Sienna Conference, Siena, Italy (Sep. 1–5, 2002)), allows the direct quantitative comparison of relative protein expression between two or more samples based on the ratio of stable isotopes in the mass spectrometer. All these applications depend on the MS for detection and are crippled by the detection efficiency of the MS. In addition to the generation of primary bioinformatic data, MS is playing a pivotal role in combinatorial chemistry and high throughput drug library screening. (Sugarman, J. H., R. P. Rava, and H. Kedar, "Apparatus and method for parallel coupling reactions," U.S. Pat. No. 6,056,926 (May 2, 2000); Schmidt, G., A. H. Thompson, and R. A. W. Johnstone, "Mass label linked hybridisation probes," EP979305A1 (Feb. 16, 2000); Van Ness, J., Tabone, J. C., H. J. Howbert, and J. T. Mulligan, "Methods and compositions for enhancing sensitivity in the analysis of biological-based assays," U.S. Pat. No. 6,027,890 (Feb. 22, 2000)).

The limiting factor in virtually all these MS bioinformatic applications is the amount of available sample. For example, the protein detection limits in 2-D gel electrophoresis are about 0.2 ng (by silver staining) (Steinberg, Jones, Haugland and Singer, *Anal. Biochem.,* 239:223 (1996)) to about 0.05 fmol (by fluorescent staining) (Haugland, R. P., "Detection of proteins in gels and on blots," in Handbook of fluroescent probes and research chemicals, Spence, M. T. Z (ed.), $6^{th}$ ed. (Molecular Probes, Inc., Eugene, Oreg., 1996)), assuming a nominal 40 kDa protein. As little as 1 fmol of unlabeled protein is needed for detection (by UV detection) (Beckman Instruments, "eCAP SDS 200: Fast, reproducible, quantitative protein analysis," BR2511B (Beckman Instruments, Fullerton, Calif., 1993)) and as little as 1–10 zmol of fluorescently-labeled proteins is needed (by laser-induced fluorescence, LIF) (Beckman Instruments, "P/ACE™ Laser-induced fluorescence detectors, BR-8118A" (Beckman Instruments, Fullerton, Calif., 1995); Harvey, M. D., D. Bandilla, and P. R. Banks, "Subnanomolar detection limit for sodium dodecyl sulfate-capillary gel electrophoresis using a fluorogenic, noncovalent dye," *Electrophoresis,* 19:2169–2174 (1998)) can be detected in capillary electrophoretic separations. However a minimum of 0.1 fmol and more typically up to 100 fmol of a protein is required for MS sequencing.

Arguably, high resolution mass spectrometry (MS) has the greatest potential chemical discrimination capacity (50–100, 000+ amu mass range with 1 ppm mass accuracy, single ion counting at the ion detector, and the broadest applicability of any analytical chemistry technology. However, mass spectrometers generally exhibit poor detection efficiency for organic samples, often in the range of 0.001–100 parts per million (ppm), or about 0.001–100 fmole (about $10^6$–$10^{11}$ starting molecules) depending on the ionization method and mass analyzer used.

Mass spectrometry (MS) fundamentally consists of three components: ion sources, mass analyzers, and ion detectors. The three components are interrelated; some ion sources may be better suited to a particular type of mass analyzer or analyte. Certain ion detectors are better suited to specific mass analyzers. Electrospray (ESI) and matrix assisted laser-induced desorportion (MALDI) ionization sources are widely used for organic molecules, particularly biomolecules and are generally preferred for the ionization of non-volatile organic species. ESI is widely practiced because it can be readily coupled with liquid chromatography and capillary electrophoresis for added discrimination capability. MALDI techniques are widely practiced on large molecules (e.g., proteins) that can be difficult to solubilize and volatize in ESI. The principle advantage of MALDI is the small number of charge states that arise from molecules with a multiplicity of ionizable groups. The principle disadvantage of the MALDI is ion detector saturation with matrix ions below about 900 amu. With the advent of micro/nano-ESI sources these two ion sources generally exhibit similar detection sensitivities over a wide range of organic materials.

The detection efficiency ($\eta_d$, equation 1) of any MS is determined from the product of the ionization efficiency ($\eta_i$, equation 2) and the transmission efficiency ($\eta_t$, equation 3). For simplicity the efficiency of the detector element is lumped into the transmission efficiency.

$$\eta_d = \eta_i \eta_t = \frac{\text{ion current at the detector}}{\text{rate of molecule liberation from the source}} \quad (1)$$

$$\eta_i = \frac{\text{ion current from the source}}{\text{rate of molecule liberation from the source}} \quad (2)$$

$$\eta_t = \frac{\text{ion current at the detector}}{\text{ion current from the source}} \quad (3)$$

The overall detection efficiency in MS is difficult to measure with good precision. There are a large number of factors that may affect ion formation, collection, transmission, and detection, which are difficult to reproduce exactly from day to day, MS to MS, and lab to lab.

Conventional wisdom for ESI mass spectrometry is that virtually all the losses occur during ion transmission into and through the mass analyzer and that ionization efficiency is close to 100%. This assumption is based on two observations: 1) total ion current measurements from the spray tip and at various positions inside the mass analyzer, and 2) most analytes exhibit multiple charge states.

Smith and coworkers (Tang, K. et al., *Anal. Chem.,* 73:1658–1663 (2001)) measured the actual total ion current (TIC) from ESI microspray tips to be about 150 nA at a 1 μl/min flow rate of a typical biomolecular sample matrix (50:50:1 methanol:water:acetic acid). Using a similar measurement apparatus, but with octanol doped with sulfuric acid as the sample matrix, de la Mora and Loscertales (De la Mora, J. F. and I. G. Loscertales, *J. Fluid Mech.,* 260: 155–184 (1994)) reported ion currents of between 50–280 nA (at 1 μl/min flow rates) that varied with the sulfuric acid concentration (between 0.3 and 3%, respectively). Both of these results translate to between $10^4$ to $10^7$ unbalanced charges per drop, assuming 1 to 10 μm drops, respectively (Table 1 below). However, de la Mora and Loscertales observed that the measured ion current was 4 times their theoretical maximum and attributed this difference to electron conductance in the apex region of the jet rather than to ion convection by droplets crossing the gap. If true, then the actual number of charges per drop may be somewhat lower than the total ion current data suggests.

Smith and coworkers (Smith, R. D., et al., *Anal. Chem.,* 62:882–899 (1990)) also attempted to estimate transmission efficiency by measuring the TIC striking a detection plate placed at various positions along the ion path in the mass analyzer. They concluded that transmission efficiency accounted for the vast majority of ion loss culminating in poor detection efficiency. The existence of multiple charge states, or more particularly that the distribution in charge states is not centered about a single charge state, is the second observation supporting complete ionization. If there were a paucity of charge, then few charge states should be seen.

Unlike ESI, it is generally accepted that ionization efficiency in MALDI is poor. One argument for this is the lack of highly-charged species generated from analytes with a large number of readily ionizable sites. For example, in positive ion mode, proteins generally ionize to generate species with +1 or +2 charges only, even though there are generally many more basic residues (i.e., Arg, Lys, and His). Levis (Levis, R. J. , *Annu. Rev. Phys. Chem.,* 45:483–518 (1994)) has clearly demonstrated, by collecting and analyzing all the material liberated from the target by the ionization laser, that MALDI ionization efficiencies are very low and that a large amount of neutralized material is ablated from the MALDI surface by the laser desorption process. This assertion is also supported by the results of Brune and coworkers (Brune, D. C. et al., poster presented at the Amer. Soc. Mass Spectro. Ann. Mtg., Chicago, Ill. (May 27–30, 2001)) who report the optimization of negative ion MALDI matrices based on the gas phase basicity of the matrix molecule. They invoked a gas phase proton transfer argument to explain why higher analyte efficiencies were seen with more basic matrices in MALDI.

SUMMARY OF THE INVENTION

In one embodiment, this invention provides a mass spectrometry ionization method in which electrospray droplets or solid sample matrices are exposed to an ion beam thereby increasing the unbalanced charge of the analyte. In another embodiment, this invention provides a mass spectrometry ionization method in which ionization of the sample is achieved by directing an ion beam at a liquid or solid sample matrix containing analyte thereby ionizing and adding unbalanced charge to the analyte.

In another aspect, the invention further provides for directing the charged analyte through the interface of the mass spectrometer in synchrony with the duty cycle of the ion detector. The analyte may be deposited upon discrete apices of the sample surface. The sample may be bacteria, viruses or cells. The ion beam may be protons, lithium ions, cesium ions, anions, such as NH2- or H3Si-, or electrons. The sample may be injected directly into the focusing quadrupoles. In a preferred embodiment, the ion beam flux may be from about 1 mA/cm2 to about 17 mA/cm2 and the ion beam energy may be from about 5 to about 50 electron volts, preferably from about 5 to about 10 electron volts. However, a higher ion flux may be used provided the ion detector does not become saturated.

In another embodiment, the invention provides a mass spectroscopy system having an analyte ion source, an ion beam, a mass analyzer, and an ion detector. Still further, the invention provides a mass spectroscopy system having an analyte sample in liquid or solid form, an ion beam, a mass analyzer and an ion detector.

DETAILED DESCRIPTION OF THE INVENTION

Figure 1:
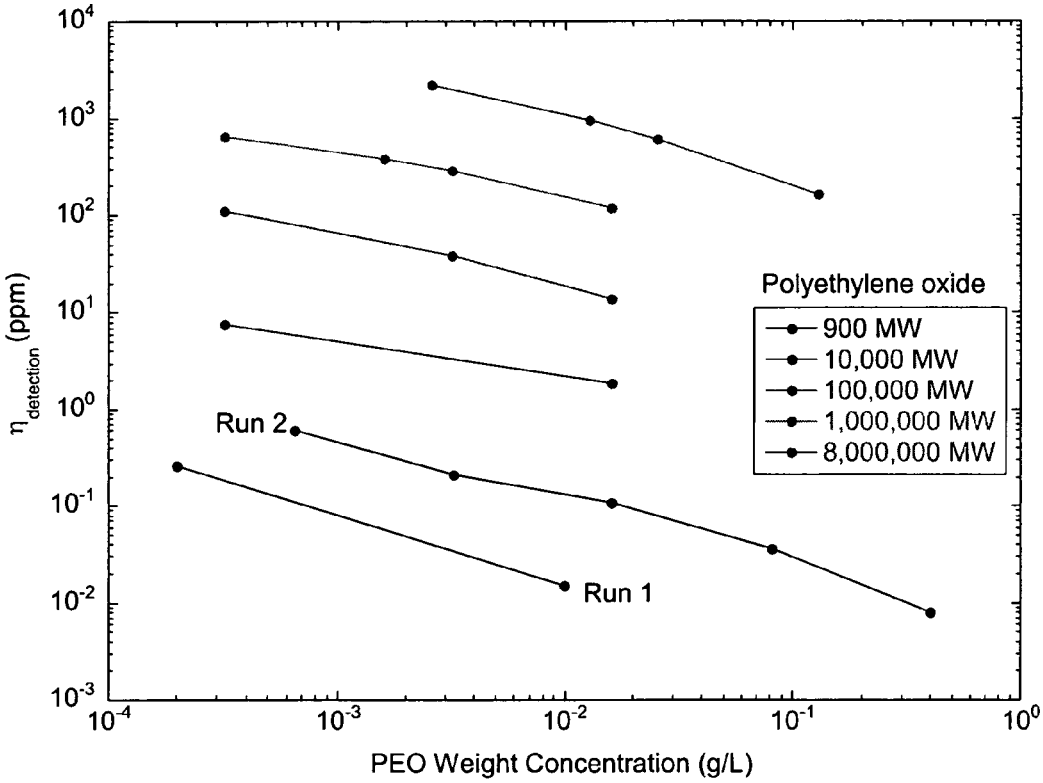
FIG. 1. The detection efficiency of various PEO polymers in ESI-TOF.

Mass spectrometry (MS) fundamentally consists of three components: ion sources, mass analyzers, and ion detectors. The three components are interrelated; some ion sources may be better suited to a particular type of mass analyzer or analyte. Certain ion detectors are better suited to specific mass analyzers. The focus of this invention is the ion source and, more specifically, the ionization process. ESI and MALDI ion sources are widely used for organic molecules, and are generally preferred for the ionization of non-volatile organic species. ESI is widely practiced because it can be readily coupled with liquid chromatography and capillary electrophoresis for added discrimination capability. MALDI techniques are widely practiced on large molecules (e.g., proteins) that can be difficult to solubilize and volatize in ESI. The principle advantage of MALDI is the small number of charge states that arise from molecules with a multiplicity of ionizable groups. The principle disadvantage of the MALDI is ion detector saturation with matrix ions below about 900 amu. With the advent of micro/nano-ESI sources these two ion sources generally exhibit similar detection sensitivities over a wide range of organic materials.

The detection efficiency ($\eta_d$, equation 1) of any MS is determined from the product of the ionization efficiency ($\eta_i$, equation 2) and the transmission efficiency ($\eta_t$, equation 3). For simplicity the efficiency of the detector element is lumped into the transmission efficiency.

$$\eta_d = \eta_i \eta_t = \frac{\text{ion current at the detector}}{\text{rate of molecule liberation from the source}} \quad (1)$$

$$\eta_i = \frac{\text{ion current from the source}}{\text{rate of molecule liberation from the source}} \quad (2)$$

$$\eta_t = \frac{\text{ion current at the detector}}{\text{ion current from the source}} \quad (3)$$

Furthermore, it should be mentioned that the overall detection efficiency in MS is difficult to measure with good precision. There are a large number of factors that may affect ion formation, collection, transmission, and detection, which are difficult to reproduce exactly from day to day, MS to MS, and lab to lab. This may explain why detection efficiency often goes unreported. In our experience differences within an order-of-magnitude are generally not significant unless reproducible over multiple experiments.

The critical question in MS is where do all the molecules go? Using an electrospray time-of-flight (ESI-TOF) MS as an example, it is obvious that there are many possibilities for ion loss. Molecules may fail to ionize in the first place, or they could form net neutral salts with entrained counterions on desolvation in ESI (Kebarle, P., *J Mass Spectroin.,*

35:804–817 (2000)) or through coupled volatilization of the analyte-salt matrix in MALDI. Ions may fail to enter the detector orifice. Micro/nanospray techniques tremendously improved the collection efficiency in ESI MS over the previous pneumatic spray technology. The inner surfaces of the MS are maintained at different potentials to create electric fields that both contain the ions while they are separated from neutral gas molecules and direct the ions to the detection element. Ions may be lost to electrostatic interactions with the inner surfaces of the MS. The MS detector must operate at high vacuum so that the mean free path of the ions to the detector element is long enough that the ion trajectory depends only on the intrinsic mass to charge of the ion itself. Therefore, some ions may be entrained in the neutral gases being removed to the vacuum pump. An orthogonal ion detector may result in additional ion losses due to the intrinsic duty cycle of the detector.

Conventional wisdom for electrospray mass spectrometry is that virtually all the losses occur during ion transmission into and through the mass analyzer and that ionization efficiency is close to 100%. This assumption is based on two observations: 1) total ion current measurements from the spray tip and at various positions inside the mass analyzer, and 2) most analytes exhibit multiple charge states.

As noted above, Smith and coworkers (Tang, K. et al., *Anal. Chem.,* 73:1658–1663 (2001)) have recently measured the actual total ion current from ESI microspray tips to be about 150 nA at a 1 μl/min flow rate of a typical biomolecular sample matrix (50:50:1 methanol:water:acetic acid). Using a similar measurement apparatus, but with octanol doped with sulfuric acid as the sample matrix, de la Mora and Loscertales (De la Mora, J. F. and I. G. Loscertales, *J. Fluid Mech.,* 260:155–184 (1994)) also report ion currents of between 50–280 nA (at 1 μl/min flow rates) that varied with the sulfuric acid concentration (between 0.3 and 3%, respectively). Both of these results translate to between $10^4$ to $10^7$ unbalanced charges per drop, assuming 1 to 10 μm drops, respectively (Table 1). However, de la Mora and Loscertales observed that the measured ion current was 4 times their theoretical maximum and attributed this difference to conductance in the apex region of the jet rather than to ion convection by droplets crossing the gap. If true, then the actual number of charges per drop may be much lower than the total ion current data suggests. Further evidence that the TIC measurements are in error is that they translate to a number of charges per drop that are far larger than the Rayleigh limit (Table 1). The Rayleigh limit is the maximum number of unbalanced charges that may exist on a drop in a vacuum before the drop spontaneously explodes due to Coulombic repulsion.

TABLE 1

Total Charges on a Electrospray Drops of Different Sizes Estimated from Total and Specific Ion Currents

| | Number of Charges Expected per Drop | | | |
|---|---|---|---|---|
| Drop Size (μm) | Estimated From PEO Data | Maximum from Coulomb's Law | Estimated from TIC Measurements | Maximum at the Raleigh Limit |
| 1 | 1.36 | 174 | 18,800–94,200 | 27,600 |
| 10 | 1,360 | 17,400 | $1.9–9.4 \times 10^7$ | 870,000 |
| 100 | 1,360,000 | 17,400,000 | $1.9–9.4 \times 10^{10}$ | 27,000,000 |

Smith and coworkers (Smith, R. D., et al., *Anal. Chem.,* 62:882–899 (1990)) also attempted to directly measure the transmission efficiency inside the mass analyzer by measuring the total ion current striking a detection plate placed at various positions along the ion path in the mass analyzer. They concluded that transmission efficiency accounted for the vast majority of ion loss culminating in poor detection efficiency. As alluded to in Smith's study, by basing their conclusions on the total ion current they tremendously overestimate the losses due to transmission efficiency. Mass analyzers are usually tuned to eliminate very small ions (e.g., protons and hydronium ions) from the ion stream. Should these species comprise the majority of the ion current, then transmission efficiency could be severely underestimated. Therefore, it is important to determine transmission efficiency for the specific ion of interest (i.e., using the specific ion current).

The existence of multiple charge states, or more particularly that the distribution in charge states is not centered about a single charge state, is the second observation used to justify the complete ionization argument. The argument is that if there were a paucity of charge, then why would multiple charge states be seen? However, it can also be argued that the ESI process produces asymmetric fission events of charged droplets during desolvation. (Kebarle, P. and L. Tang, *Anal. Chem.,* 65:972A–986A (1993)). Charged analyte at the surface of the drop may continue to pick up additional charge due to cooperativity as it moves into the gas phase. This assertion is supported by evidence that the fissioning droplets appear to carry away the bulk of the charge during desolvation and drop breakup, leaving little charge remaining on the parent drop. (Kebarle, P. and L. Tang, *Anal. Chem.,* 65:972A–986A (1993)). In essence, this would produce a quasi-bimodal distribution of two possible populations of analyte: 1) highly-charged species which give rise to the envelope of peaks in ESI-MS and 2) non-ionized analyte that remains undetected. Thus, although charge is limited, droplet heterogeneity, particularly during the fissioning and breakup process, may explain the absence of detected species with intermediate numbers of charges in between these two populations.

Figure 2:
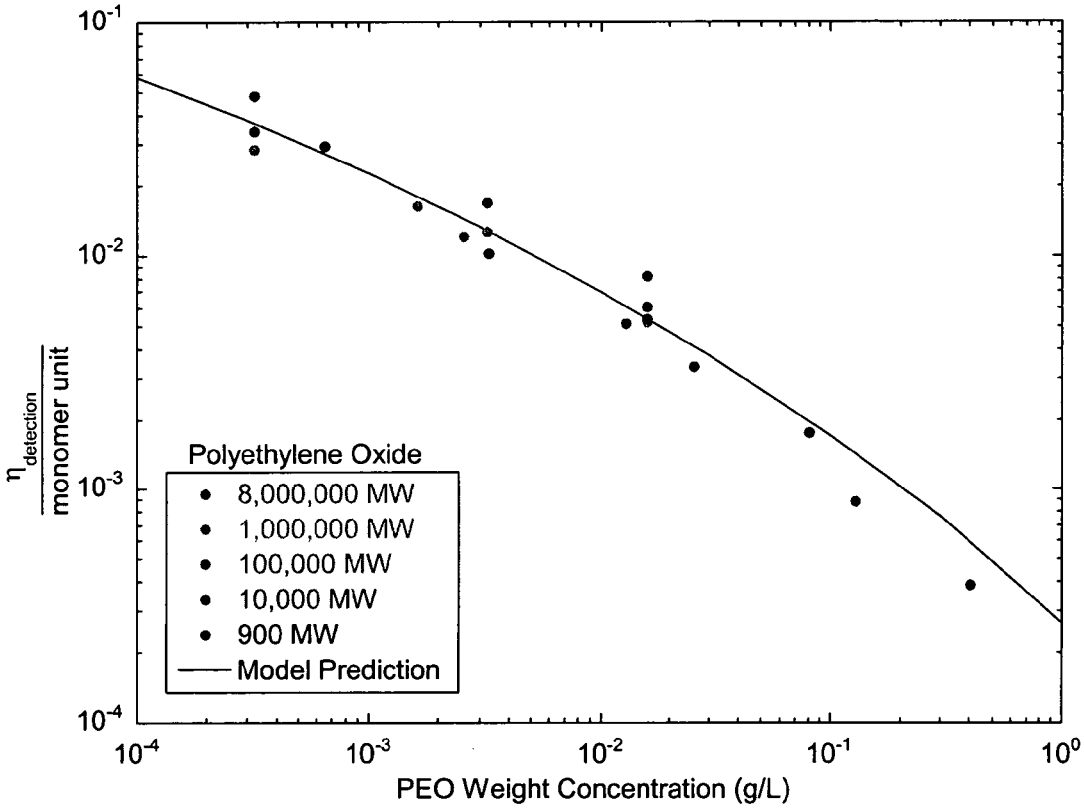
FIG. 2. PEO monomer detection efficiency as a function of weight fraction.

One method to address these open questions about ionization efficiency is to measure the specific ion current produced by a series of ionizable homopolymers, such as polyethylene oxide (PEO), of varying chain length at the same weight fraction of monomer (FIG. 2). A polymer chain containing more ionizable residues should have a statistically better chance to compete for the available charge at the same volume or weight fraction of monomer. When solutions of PEO polymers of various chain lengths are subjected to electrospray ionization in an ESI-TOF MS, we see clearly that the detection efficiency scales proportionally with the chain length (FIG. 2). We also find that at the longest chain length (8 MDa, 182,000 monomer units) the detection efficiency exceeds 0.1% (1000 ppm), which is the theoretical transmission efficiency quoted by the manufacturer (Applied Biosystems) for the Mariner™ instrument used. Since the detection efficiency of the highest molecular weight PEO tested is at or near the reported transmission efficiency for our instrument, it is clear that the lower molecular weight species do not exhibit 100% ionization efficiency.

Assuming that each monomer in the polymer chain acts independently and has a defined affinity for the available charge, it is possible to develop a model for ionization efficiency of PEO along the lines of that reported by Enke (Enke, C. G., *Anal. Chem.,* 69:4885–4893 (1997)) for singly-charged analytes. This model results in a quadratic solution for the monomer detection efficiency ($\eta_m$) in terms of a relative charge separation constant ($\alpha$) between the total concentration of ionizable residues of PEO ($C_m^T$), the total concentration of a hypothetical species competing for the available charge ($C_c^T$), and the total droplet charge ($C_T$)

$$\eta_m = \frac{(1-\alpha)C_T - \alpha C_m^T - C_c^T \pm \sqrt{4\alpha C_T(1-\alpha)C_m^T + [(1-\alpha)C_T - \alpha C_m^T - C_c^T]^2}}{2(1-\alpha)C_m^T} \quad (4)$$

Taking the limit as $C_T \rightarrow 0$, we can prove that only the positive root of equation 4 is valid. Since we assume that the ionization efficiency of the monomer ($\eta_m$) is constant, independent of the polymer chain length, then we can condense the polymer detection efficiency data presented in FIG. 2 by dividing the polymer efficiency ($\eta$) by the average number of monomer units per chain ($n_m$). In fact, this results in a single curve (FIG. 3) that eliminates the differences between polymers of different chain lengths. This also suggests that the transmission efficiency is constant for mass to charge ratios of between 200 and 1500, which is the range covered by the various PEO chain lengths.

Figure 3:
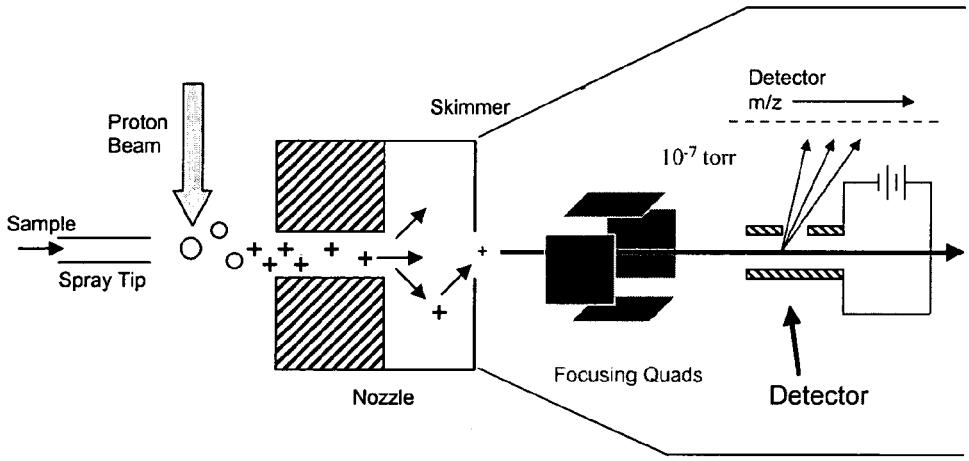
FIG. 3. Illustration of an embodiment of a mass spectrometry ionization method.

Using the data of FIG. 3, we can estimate the parameters $\alpha$, $C_C^T$, and $C_T$ if we assume a transmission efficiency ($\eta_t$). Applied Biosystems, the manufacturer of the mass spectrometer used for these studies, has suggested that the transmission efficiency is theoretically about 0.1%. If we assume that the ionization efficiency of the 8 MDa PEO is close to unity, then the actual transmission efficiency can be estimated to be around 0.167% (1 in every 600 ions). Using this value the total charge concentration ($C_T$) is estimated to be about $4.3\times10^{-9}$M. The total concentration of competing species ($C_C^T$) is estimated to be about $4.4\times10^{-9}$ M and $\alpha$ to be about $1.3\times10^{-6}$. The best model fit to the data is also shown as the solid line in FIG. 3.

This model suggests several things. First, it suggests that all ionizable groups compete independently for a limited amount of unbalanced charge on the electrospray drop. Second, it suggests that analyte also competes with itself for this charge, such that increasing the analyte concentration can reduce the ionization efficiency, particularly for species that do not compete well for the available charge. Finally, with an estimate of the total charge concentration ($C_T$) we can make an estimate of the total number of unbalanced charges on a drop (Table 1). Because we lump all possible charge-competing species into a single species and we don't have a firm estimate of the actual transmission efficiency, it is possible that the total charge concentration estimated by curve fit to the model may underestimate the actual unbalanced charge concentration on the drop.

A great deal of effort has already gone into the optimization of ion transmission inside the detector, with zmol ion efficiencies being achieved even through tandem MS detectors. (Belov, M. E. et al., *Anal. Chem.,* 72:2271–2279 (2000)). This high transmission efficiency is readily demonstrated by a few simple experiments. Collection efficiency can be tested by the use of a low pressure ESI head, simplified from that described by Karger. (Felton, C., et al., *Anal. Chem.,* 73:1449–1454 (2000)). Because the ESI source and nozzle are sealed from the atmosphere, all gas phase ions created at the spray tip must enter the mass analyzer. The diameter and length of the capillary are manipulated to alter the sample flow rate under vacuum. Mimicking normal atmospheric microspray conditions (i.e., 1.0 μl/min flow rate of a solution containing 10 μM each of 3 peptides), we found that the overall detection efficiency of these peptides (1–10 ppb) was at the low end but within experimental error of that routinely observed in normal microspray operation (5–50 ppb). Therefore, the micro/nanospray collection efficiency appears to be near 100%.

These values are consistent with the sensitivity specifications established for the instrument by the manufacturer and have remained invariant in weekly calibrations conducted over 3 years of operation. The detection efficiency of myoglobin (a 17 kDa protein) and triethylamine have both remained in the same 0.1–100 ppb range through multiple experiments conducted over many months. These results demonstrate the generality of the ionization efficiency problem.

By moving the spray tip past the nozzle and skimmer, so that the sample is injected directly into the focusing quadrupoles, we further demonstrated negligible losses to the vacuum pump or inner surfaces of the detector. It is in the nozzle and interface region where the mean free ion path is the shortest and the potential for ion entrainment in the neutral gas stream is the greatest. In these experiments, conducted with the same peptide mix described above, we obtained detection efficiencies in the 0.01 to 1 ppb range. While this is lower than previous results, further testing revealed that this difference was entirely attributable to analyte adsorption to the inner walls of the long (up to 250 cm) uncoated capillaries used for sample introduction.

Detector duty cycle in orthogonal TOF detectors is fundamentally limited by flight time of the ions and is about 20%, according to Applied Biosystems (ABI), the manufacturer of our current Mariner™ (ESI-TOF) system. Axial TOF and FT-ICR systems may be used to increase the detection efficiency since all the ions are collected and released at once to the sensor element. However, ICR duty cycles are limited by the mass accuracy desired, with increased time in the ICR higher mass resolution is obtained but at the expense of the overall duty cycle of the analyzer. Similarly, tandem or triple quadrupole analyzers may also appear to improve detection sensitivity, because ions may be accumulated for a long time from the source before being released to the ion detector. In applications where mass accuracy is not critical, axial TOF detectors may be used, which intrinsically count all the ions reaching the sensor element. ABI independently estimates the overall transmission efficiency of their Mariner platform at ≧0.1%. This is consistent with transmission efficiencies cited by others. (Belov, M. E. et al., J Am Soc Mass Spectrom, 11:19–23 (2000); Martin S. E., J. Shabanowitz, D. F. Hunt, and J. A. Marto., Anal Chem, 72:4266–4274 (2000)). Aside from the duty cycle of the detector element, our experiments suggest that ionization efficiency is the major source of ion loss through the MS process.

The above evidence suggests that there is a fundamental limit on the ionization efficiency. We believe that this fundamental limit is due to charge separation (i.e., the electroneutrality constraint). If we revisit the issue of droplet formation from the Taylor cone, it is apparent from local electroneutrality constraints that, in the absence of an electric field, every cation must be balanced by a neighboring anion (i.e., all organic ions must be present as salts, albeit solvent separated, in the liquid phase). When the electric field is applied, charge separation in the liquid begins to occur and a local charge imbalance is forced at or near the liquid surface. The degree of charge separation that can occur depends on the magnitude of the applied field. At 10,000 V/cm, dielectric breakdown occurs in air, electron flow from the grounded surface to the spray tip begins, and there is a cessation of droplet formation. Therefore, this field strength represents the maximum potential that can be applied for charge separation.

Approaching the problem of charge separation from Coulomb's Law, the electrical potential ($\Psi$) required to accomplish separation of a drop of unit charge (q) from the spray tip is given by:

$$\psi = \left(\frac{q}{4\pi\varepsilon_o\varepsilon}\right)\left(\frac{1}{R_d}\right) \quad (5)$$

where $R_d$ is the effective drop radius, $\in_o$ and $\in$ are the permittivity of vacuum and the $\in$ dielectric constant of air (≈1). From equation 5, the separation of a single drop of unit charge is predicted to require a potential of 3–0.3 mV for 1 and 10 μm drops, respectively. This translates to field strengths of between 60 and 0.6 V/cm for 1 and 10 μm drops, respectively. The electrical field strength of ESI is ultimately limited by the dielectric breakdown of air (10,000 V/cm); therefore, we expect a maximum of about 174 unbalanced ions per 1 μm drop and 17,400 unbalanced ions per 10 μm drop (Table 1). These estimates are about 2 orders-of-magnitude higher than that estimated from the PEO data (Table 1) and 2 orders-of-magnitude lower than the Rayleigh limit in the 1–10 μm drop diameter range. The shape of the droplet and distribution of unbalanced charges within the droplet in addition to the electric field shape around the droplet and spray tip will all affect this prediction. Clearly, this overall analysis shows, however, that the ionization process in ESI is still not completely understood and that the ongoing assumption of likely 100% ionization efficiency may well be fallacious.

Also of interest in Smith's work is the observation (Tang, K. et al., *Anal. Chem.,* 73:1658–1663 (2001)) that the total ion current scales precisely with the number of separate spray tips (i.e., 9 tips yields 9 times the ion current of a single tip operated at the same volumetric flow rate per spray tip). This observation is consistent with de la Mora and Loscertales semi-empirical dimensional analysis of ESI, in which they suggest that there is an upper bound for the ion current at the tip of a Taylor cone determined by the dielectric constant of a vacuum (i.e., $\in \rightarrow 1$) and $Q^{-1/2}$. (De la Mora, J. F. and I. G. Loscertales, *J. Fluid Mech.,* 260: 155–184 (1994)). This observation supports our assertion that there is a maximum number of unbalanced charges that can be carried per drop and that this maximum number is determined by charge separation at the spray tip, not the Rayleigh (Kebarle, P., *J. Mass Spectrom.,* 35:804–817 (2000)) limit for droplet breakup.

Obviously, once desolvation has occurred or salt clusters are otherwise formed in the gas phase (e.g., MALDI ionization), the field strength required to separate the contact ion pairs becomes prohibitive ($R_d \rightarrow 10^{-9}$ m and $\Psi \rightarrow 17{,}000$ kV/cm, which is more than 3 orders-of-magnitude greater than the dielectric breakdown of air). Space limitations prevent a similarly full analysis of MALDI ionization, however, it is easy to see how it would be difficult to separate any salts formed during volatilization of the MALDI matrix, and any entrained organic ions (once in the gas phase), based on this charge separation argument (Equation 5). In general, 1–100 fmol of protein is needed to obtain a detectable signal in most modem MALDI instruments.

Unlike ESI, it is generally accepted that ionization efficiency in MALDI is poor. One argument for this is the lack of highly-charged species generated from analytes with potentially a large number of ionization sites. For example, in positive ion mode, proteins generally ionize to generate species with +1 or +2 charges only, even though there are generally many more basic residues (i.e., Arg, Lys, and His). Levis (Levis, R. J. , *Annu. Rev. Phys. Chem.,* 45:483–518 (1994)) has clearly demonstrated, by collecting and analyzing all the material liberated from the target by the ionization laser, that MALDI ionization efficiencies are very low and that a large amount of neutralized material is ablated from the MALDI surface. This assertion is also supported by the results of Brune and coworkers who report (Brune, D. C. et al., poster presented at the Amer. Soc. Mass Spectro. Ann. Mtg., Chicago, Ill. (May 27–30, 2001)) the optimization of negative ion MALDI matrices based on the gas phase basicity of the matrix molecule. They invoked a gas phase proton transfer argument to explain why higher analyte efficiencies were seen with more basic matrices in MALDI. Therefore, we expect that the proposed ion gun solution to this ionization problem (below) should be generically applicable to both ESI and MALDI techniques.

The primary advantage of this invention is to improve the MS detection efficiency of organic molecules to at least the 10 zmol level (0.1%) for orthogonal MS detectors and the ymol level (10%) for axial MS detectors. This increase represents a 5 orders-of-magnitude leap over current ESI and MALDI MS detection efficiencies. Many researchers have been working on incremental improvements in MS performance since the invention of mass spectrometry. Most of this work has focused on improving the transmission of the ions through the mass analyzer to the detector element. However, contrary to conventional wisdom, we present strong empirical evidence that poor ionization efficiency, not the fate of the ions inside the mass spectrometer, is the root cause of the poor detection efficiency in mass spectrometers. On the weight of this evidence and supporting models, we propose the use of ion guns to increase the unbalanced charge available to promote ionization. This approach represents a technological breakthrough for the field.

It is clear that an innovative new approach for improved organic molecule ionization is needed to bridge this $5^+$ order-of-magnitude gap in MS detection efficiency. Our basic technical approach is to generate additional unbalanced charge by adding (in positive ion mode) or removing protons (in negative ion mode) protons from the sample of interest. This may be achieved by use of a proton ion beam to generate positively charged ions or an electron or anion beam to generate negatively charged ions. For ESI, the ions may be introduced to the drops during desolvation. For MALDI, the ions or electrons may be introduced directly to the solid sample matrix by using an ion or electron beam in tandem with the desorption laser.

Ion beams also have other benefits in addition to greatly increasing MS detection efficiency of organic molecules. Instead of using the ion or electron beam in combination with the applied electrospray potential, ionization may be successfully induced by application of the ion or electron beam directly to analyte without the assistance of the spray potential. Bypassing the application of spray potential has at least two significant advantages over normal electrospray: (1) avoiding the redox chemistry that is always associated with ESI and which can degrade samples (e.g., reduce disulfide bonds, dissociate specific non-covalent complexes by changing pH), and (2) the ability to provide "ions-on-demand" which could greatly reduce sample consumption by synchronizing ion formation with detection on multichannel detection instruments, such as FT, TOF, and ion trap mass spectrometers. With electrospray ionization, sample is continuously consumed whereas a pulse of ions is necessary for TOF and ideal for FT and ion trap instruments for optimum sample utilization, i.e., 100% duty cycle. While methods for bunching ions can be used, none of them approach 100% efficiency. An "ions-on-demand" pulsed source may be implemented by directly charging the solution at the end of a capillary using a proton beam and directing the resulting charged droplet through the interface into the mass spectrometer. Mass spectra may be acquired from all ions formed from a single droplet. An alternate strategy is to form droplets on demand using a piezoelectric droplet generator, introduce them through an interface, and charge each droplet using an ion beam. A similar strategy may be used for the direct and rapid analysis of single particles, such as bacteria or viruses, which are sampled from the atmosphere in real time. Real time single particle analysis has been done using laser ablation TOF MS that provides elemental and limited molecular information on small molecules. (Morrical, B. D. et al., *J. Am. Soc. Mass Spectrom.,* 9:1068–1073 (1998)). Ion beams of sufficient energy may fragment and directly ionize proteins and other biomarkers in bacteria and viruses. The resulting ion spectrum from each particle may potentially provide a unique fingerprint of these types of samples without time-consuming accumulation and sample preparation methods.

In MALDI, the proposed ion or electron beams may ablate and ionize samples directly without the need for the laser and matrix. This simplifies sample preparation, i.e., the samples may be directly dried to a surface that has sharp ridges or oriented nanowires that would provide high electric fields upon charging with an ion beam. This eliminates both the need for a photon absorbing matrix and the associated matrix impurity peaks that limit normal MALDI analysis in the lower m/z range.

This new empirical evidence and theoretical argument clearly points to ionization efficiency being the limiting factor in MS sensitivity. Thus, since poor detection efficiency in MS is caused primarily by poor ionization, the addition of excess unbalanced charge would greatly enhance the detection efficiency. This cannot be achieved, however, by increasing the field strength in both ESI and MALDI due to dielectric breakdown constraints. The present invention overcomes this limitation by adding additional unbalanced charge through the use of ion guns. A proton gun would be used to add increase the charges in positive ion mode. Similarly, a low energy electron beam, with an energy below that needed to generate secondary fragmentation, or anion gun would be used to scavenge residual protons in negative ion mode.

Fast atom bombardment (FAB), an ionization technique normally associated with solid surface analysis (e.g., metal and metal oxide) (Mathieu, H. J. and D. Leonard, *High Temp Mater and Processes,* 17:29–44 (1998)) and atomic level surface cleaning, (Mahoney, J. F., U.S. Pat. No. 5,796,111, (Aug. 18, 1998): Mahoney, J. F., U.S. Pat. No. 6,033,484 (Mar. 7, 2000)) has also been used for the ionization of organics from liquid matrices. (Cornett D. S., T. D. Lee and J. F. Mahoney, *Rapid Commun Mass Spectrom* 8:996–1000 (1994): Mahoney J. F., D. S. Cornett, and T. D. Lee, *Rapid Commun Mass Spectrom* 1998:403–406 (1994); Mahoney, J. F. et al., *Rapid Commun Mass Spectrom;* 5:441–445 (1991)). Typical FAB sources include $Cs^+$ or $Li^+$. These ions are accelerated by an electric or magnetic field towards a surface in a vacuum, striking the surface with a enough momentum to cause ablation or sputtering of part of the surface, liberating neutral atoms and ions from the collision surface. FAB is often used as the initial sputtering source for secondary neutral mass spectrometry (SNMS) methods. (Mathieu, H. J. and D. Léonard, *High Temp Mater and Processes,* 17:29–44 (1998)). It has been used to enhance the ionization efficiency of peptides, but leads to significant levels of fragmentation, which could only be partly controlled by derivatization. (Wagner, D. S., et al., *Biol. Mass Spectrom.,* 20:419–425 (1991)).

While ions with a large momentum are needed to ablate solid surfaces, lower momentum ions (e.g., protons) may be suitable for adding unbalanced positive charge to ion clusters or droplets already released from a surface by ESI or MALDI methods. Smith and coworkers showed that passing droplets generated by ESI through a corona discharge (Ebeling, D. D., et al., *Anal. Chem.,* 72:5158–5161 (2000).) or a bath gas of ions created from an a-particle source (e.g., $^{241}$[Am] or $^{216}$[Po]), (Scalf, M., M. S. Westphall, and L. M. Smith, *Anal. Chem.,* 72:52–60 (2000).) reduces the number of multiple charge states on proteins and DNA. In these cases, the bath ions are able to penetrate the ion cluster, neutralizing or stripping unbalanced protons and electrons from the ionized residues on the proteins. Inductively coupled plasma MS (ICP-MS) is also used for high sensitivity elemental analyses, but is generally limited to metals analysis. (Dombovari, J., J. S. Becker, and H. -J. Dietze, *Fresenius J Anal Chem,* 367:407–413 (2000)). However, in all these cases the ion bath through which the droplets passed contained both positive and negative ions, as well as free electrons, so the mechanism of charge reduction is unclear. Furthermore, the effects on detection efficiency were not reported.

Evidence that a low energy proton beam may be able to increase ionization efficiency also comes from the use of electron beams in MS. Electron beams (ranging from 20 to 1000 eV) have been used previously to ionize neutral inorganic gases in MS (e.g., $CO_X$ and $NO_X$.). (Adamczyk B, K. Bederski, and L. Wojcik, *Biomed Environ Mass Spectrom;* 16:415–7 (1988)). These high energy electrons generate a multiplicity of positive ions from the inorganic gases and are of sufficient energy that they fragment organic molecules in the gas phase. (Biggs J. T. et al., *J Pharm Sci* 65:261–8 (1976)). However, lower energy electron beams (e.g., 0.025 to 30 eV) (Laramee J. A., C. A. Kocher, and M. L. Deinzer, *Anal Chem* 64:2316–2322 (1992)) and collision stabilization techniques (Berkout VD, P. H. Mazurkiewic, and M. L. Deinzer, *Rapid Commun Mass Spectrom.,* 13:1850–4 (1999)) used in conjunction with higher energy electron beam ionization MS have been used to enhance the formation of negative organic ions in electron capture negative ion mass spectrometry.

Similar to the experience with electron beams, high energy MeV to GeV proton beams are being used as a replacement for excimer lasers and X-rays in surgical applications, (Harsh G, J. S. et al., *Neurosurg Clin N Am.,* 10:243–56 (1999); Hug E B and J. D. Slater *Neurosurg Clin N Am;* 11:627–38 (2000); Krisch E. B. and C. D. Koprowski, *Semin Urol Oncol;*18::214–25 (2000)) and as a replacement for fast atom surface cleaning techniques. While, these protons are far too energetic for our purposes, these uses support the assertion that ion beams may be used directly as the ionization mechanism (ion-on-demand) not just in conjunction with ablating laser or electrospray techniques. We have determined that a 50 eV proton (National Electrostatics Corporation (NEC)) will penetrate water to a depth of about 1 μm, while a 5 eV proton will penetrate to a depth of 0.15 μm. The first ionization potential of C is greater than 11 eV; therefore, a 5–10 eV proton should not strip electrons from organic molecules but should serve to add unbalanced protons to the ESI droplet or ion cluster. Such protons should act to neutralize any anions present in the salt or droplet and enhance organic ionization.

The NEC proton beam will only provide sufficient ion current below 100 torr because of ion losses to bath gas collisions. This is not a problem for MALDI, which is already conducted at lower pressures, and we have already demonstrated a low pressure ESI head.

The remaining consideration is the proton flux needed to ensure that a sufficient number of protons are delivered to the ion clusters or droplets in the time available. This flux is the ion current per unit area. Analysis of the flow dynamics of a typical micro/nanospray ESI system (≦1.0 μL/min of a 1% acetic acid solution) suggests that a maximum balancing proton current of 260 μA may be needed. The nozzle opening on the MS detector accepting this ion current has a diameter of about 0.025 cm. The spray tip may be positioned at any distance from about 0 (centered in the nozzle) to 0.6 cm away from the nozzle, presenting a maximum crossection for the ion current of 0.15 $cm^2$ and the need for an ion flux of about 17 $mA/cm^2$. However, very little of the acetic acid is ionized at the matrix pH, so the proton flux required may be substantially less than 17 $mA/cm^2$. Lowering the sample delivery rate to the spray tip to 0.1 μl/min also cuts this requirement to 1.7 $mA/cm^2$. The NEC source delivers a proton current of 10 μA in a beam dimension crossection of about 0.01 $cm^2$ for a proton flux of about 1 $mA/cm^2$, close to the minimum theoretical requirements. An alternative configuration is to inject the ion beam along the axis of ion flow from the target or spray tip through the mass analyzer this means positioning the ion gun at the terminal end of the ion beam in the mass analyzer, such that the ions ejected from the ion gun oppose the flow of source ions through the detector. Another suitable configuration is to offset the spray tip or target from the ion flow direction through the mass analyzer, then applying the ion beam from the ion gun coaxially, and in the same direction, with the normal sample ion path.

The low energy proton beam approach is also only suitable for organic compounds containing nitrogen, oxygen, and sulfur heteroatoms that are readily ionized to form positive ions. When the organic molecule is not fragmented or ionized by stripping electrons from the outer molecular orbitals, then the ion must be formed by protonation of a weakly basic heteroatom deprotonation of a weakly acidic heteroatom contained in the molecular structure. Fortunately, most bioactive compounds contain such heteroatoms; therefore, this approach remains widely applicable.

A complicating issue in MALDI is the interaction of the ionization matrix with the ion beam. MALDI matricies (Table 2) have been optimized over the years for maximum interaction with the lasers used for ionization and their ability to transfer charge to the analytes of interest.

Detection efficiencies in negative ion mode, which is often used to investigate phosphorylated (nucleic acids and phosphorylated proteins), sulfonated and carboxylated (fatty acids) organic species, have generally proved to be lower than those observed in positive ion mode. Here we believe that the problem is an overabundance of protons or unionized proton donors in the matrix. It can be imagined that the various proton donors compete to be rid of any available protons in negative ion mode. Therefore, it is reasonable to expect that an anion beam or even a low energy electron beam may serve to scavenge excess protons and improve the ionization efficiency of negatively charged species.

As discussed above, electron beams (E-beams) have been used to promote the ionization of organic molecules lacking proton donating and accepting sites (e.g., aliphatic and aromatic hydrocarbons). In these applications a high energy E-beam is directed at the neutral gas stream containing the analyte. Collisions between a high-energy electron and the analyte produce radical ions by stripping additional lower energy electrons or proton radicals from the analyte. The resulting radical ions, or their recombination products, are then transmitted and detected by the mass analyzer. For biomolecular sensitivity enhancement where labile acidic protons generally exist, high energy E-beams may not be ideal due to generic fragmentation and chemical reactivity concerns. In these cases, the use of a low energy E-beam may lead to removal of the more labile acidic protons (to form hydrogen radicals or hydrogen gas), thereby retaining the typical "soft" ionization of normal ESI and MALDI. The predominant benefit of examining E-beams is the commercial availability of inexpensive E-beams with tunable energies from 0–100 keV (Kimball Physics, Wilton, N.H.).

Alternatively, the generation of a wide variety of atomic or molecular anionic beams of specific energies is viable. For example, Mitchell et al. describe the generation of methide ($CH_3^-$) beams of various energies. (Mitchell, S. E., et al., poster presented at the American Physical Society DAMOP Mtg., Santa Fe, N.M. (May 27–30, 1998)). Using methane as a precursor, the resulting methide beam is very weak; however, an intense beam can be produced using diazomethane as the precursor. Methide anions of any energy, however, are most likely not suitable for biomolecular sensitivity enhancement, based on its very high gas-phase proton affinity relative to exemplary acidic protein and nucleic acid residues (Table 3). A methide ion beam would most likely remove protons indiscriminately, leading to possible fragmentation or unwanted side reactions such as β-eliminations. Selection of an anion with a lower gas-phase affinity may be more appropriate. For example a beam of $NH_2^-$ may be a more appropriate choice (Table 3) because its proton affinity is above that of water (believed to be the source of excess protons) and lower than that of methide (suggesting that it will not strip aliphatic hydrogens). Thus, the $NH_2^-$ beam would be expected to adequately deprotonate and ionize the analyte without reprotonation of the analyte by water. An $NH_2^-$ beam should be easily generated from an ammonia plasma. While the gas-phase proton affinity is the most likely metric for MALDI, liquid-phase basicities may be a more appropriate metric to select an anion beam for ESI since the mechanism of ionization lies at the interface of liquid- and gas-phase chemistries. As an argument for a selection of an anionic beam for sensitivity enhancement in MALDI, "soft" negative ion mode ionization may be obtainable for nucleic acid and protein ionization by selection of an anion with a proton affinity higher than phosphodiester (1360 kJ/mol) and carboxylate (1429 kJ/mol), but less than other side-chain moieties such as aliphatic alcohols (1569 kJ/mol) (Table 3). A possible contender is $H_3Si^-$, with a proton affinity of 1525 kJ/mol). A beam of $H_3Si^-$ should be readily obtainable from $SiH_4$ plasma or by mass-selection upon sputtering from an appropriate Si surface.

TABLE 2

Common MALDI Ionization Matricies (Fluka, MALDI-Mass Spectrometry, Analytix (Sigma-Aldrich, St. Louis, MO, June, 2001))

| Analyte | Matrix | Laser |
|---|---|---|
| Peptide/Protein | α-cyano-4-hydroxycinnamic acid | IR |
| | sinapic acid | IR |
| | 2-(4-hydroxyphenylazo)benzoic acid | IR |
| | succinic acid | IR |
| | 2,6-dihydroxyacetophenone | UV |
| | ferulic acid | UV |
| | caffeic acid | UV |
| Oligonucleotides | 2,4,6-trihydroxyacetophenone | |
| | 3-hydroxypicolinic acid | |
| | anthranilic acid | |
| | salicylamide | |
| | nicotinic acid | |
| Organic Molecules | 2,5-dihyroxybenzoic acid | IR |
| | isovanillin | |
| Carbohydrates | 2,5-dihydroxybenzoic acid | IR |
| | α-cyano-4-hydroxycinnamic acid | IR |
| | 3-aminoquinoline | UV |
| | 1-isoquinolinol | UV |
| | 2,5,6-trihydroxyacetophenone | UV |
| Lipids | dithranol | IF |

TABLE 3

Gas-Phase Proton Affinities of Selected Anions (Values compiled from the NIST Chemistry WebBook, Standard Reference Database No. 69, July 2001)

| Anion | Proton Affinity (kJ/mol) |
|---|---|
| $CH_3^-$ | 1710 |
| $NH_2^-$ | 1660 |
| $OH^-$ | 1607 |
| $CH_3O^-$ | 1569 |
| $H_3Si^-$ | 1525 |
| $C_6H_5O^-$ | 1430 |
| $CH_3COO^-$ | 1429 |
| $Cl^-$ | 1360 |
| $(CH_3O)_2P(=O)O^-$ | 1373 |
| $I^-$ | 1294 |

ESI provides the greatest potential for success since the ions can be introduced to the droplet after it leaves the spray tip and before desolvation where solvent separation of the ion pairs may assist us in charge separation before the formation of salt clusters. A low pressure ESI microspray head can be used with an off-the-shelf TOF analyzer. The head design may be altered by the extension of the spray chamber to allow the introduction of an ion beam or laser perpendicular to the spray direction. In addition, a separate port may be added for the controlled addition of gases through a micro-metering valve to maintain pressure control of the spray chamber. The same test system with minimal modification will serve all subsequent tasks involving ESI.

We believe that the low energy (5–50 eV) proton beam (NEC) is the most logical starting choice for positive-ion mode MS. A low-pressure MALDI ionization head may be modified to accept an ion gun in tandem with the ablation laser. The positioning of the laser and ion gun will be optimized to maximize sample ionization, using the same NEC proton beam. A thermal desorption system (i.e., infrared laser) rather than UV lasers for this test bed may be used to minimize the potential confounding effects of UV induced fragmentation and recombination with energetic protons.

TABLE 4

Summary of Key Innovative Approaches

| Key Variables | Innovative Approaches |
|---|---|
| MS Sensitivity | |
| (+) ion mode ESI | Novel ionization methodology (ion beams) |
| (−)-ion mode ESI | Novel ionization methodology (electron or anion "proton-scavenging" beams) |
| (+)-ion MALDI | same as above |
| (−)-ion MALDI | same as above |
| Ion-on-Demand | |
| Liquid-phase | Direct ionization with ion beams |
| Solid-phase | 1) Direct ionization with ion beams<br>2) Articulated surface |
| Particulate fingerprinting | Direct particulate charging and fissioning with ion beams |

The optimal electron beam would be of sufficient energy to neutralize labile protons of the analyte (i.e., carboxylate protons) without removal of protons of much higher pKa or induction of unwanted side reactions such as eliminations or rearrangements. An alternative anionic "proton scavenging" beam. The appropriate anion would have sufficient gas phase basicity to remove labile protons of the analyte without pervasive side reaction with organic analytes.

Independent of any sensitivity enhancement provided in either ESI or MALDI applications, ion beams have the potential to produce ions-on-demand. The key to success in this application is the ability to add sufficient charge to a well insulated surface to drive molecules from that surface by charge repulsion (i.e., reach a Raleigh limit). As discussed above, this approach potentially eliminates the electrochemical complications seen in electrospray ionization and the photochemical complications seen in MALDI applications. Ion beams may thus be used as the sole ionization method, rather as an adjunct to traditional ESI and MALDI methods.

Since ionization will depend on charge repulsion, the MALDI surface needs to be electrically insulating. Polymeric surfaces may themselves ionize and contaminate the resulting spectrum. Silicate and aluminate ceramics may be substituted as well as insulating backings with metal (gold and stainless steel) targets. Furthermore, non-planar geometries of the MALDI surface may also be used such as those needed for field desorption ionization where maximum ionization occurs at the tips of a spiked surface.

In lieu of an aerosolizing system, intact samples of a bacterial and viral test system may be deposited on a MALDI target and ionized from the target to obtain a unique fingerprint from each species.

What is claimed is:

1. A mass spectrometry ionization method comprising:

delivering electrospray droplets from an electrospray tip of an electrospray ionization mass spectrometer, wherein the electrospray droplets contain solvent and analytes; and exposing the electrospray droplets to a proton beam thereby increasing the unbalanced charge of the electrospray droplets, wherein the proton beam energy is from 5 to 10 eV.

2. The method of claim 1, wherein the droplets are injected into quadrupoles of the electrospray ionization mass spectrometer.

3. The method of claim 1, wherein the analyte comprises organic compounds having nitrogen, oxygen, or sulfur heteroatoms.

4. The method of claim 1 wherein the proton beam flux is from 1 $mA/cm^2$ to 17 $mA/cm^2$.

5. The method of claim 1, wherein the electrospray flow rate is from 0.025 μL/min to 0.5 μL/mm.

* * * * *